US008122828B2

(12) United States Patent
Tedde

(10) Patent No.: US 8,122,828 B2
(45) Date of Patent: Feb. 28, 2012

(54) CARTRIDGE FOR A FIREARM

(76) Inventor: Salvatore Tedde, Ardara (IT)

( * ) Notice: Subject to any disclaimer, the term of this patent is extended or adjusted under 35 U.S.C. 154(b) by 0 days.

(21) Appl. No.: 12/680,896

(22) PCT Filed: Oct. 1, 2008

(86) PCT No.: PCT/EP2008/063152

§ 371 (c)(1),
(2), (4) Date: Mar. 30, 2010

(87) PCT Pub. No.: WO2009/043876

PCT Pub. Date: Apr. 9, 2009

(65) Prior Publication Data

US 2010/0212530 A1 Aug. 26, 2010

(30) Foreign Application Priority Data

Oct. 1, 2007 (IT) ..... RM2007A0505

(51) Int. Cl.
*C06C 7/00* (2006.01)

(52) U.S. Cl. .... 102/202; 102/204; 102/430; 102/275.11

(58) Field of Classification Search ..... 102/200, 102/202, 204, 275.11, 430, 523
See application file for complete search history.

(56) References Cited

U.S. PATENT DOCUMENTS

| | | | | |
|---|---|---|---|---|
| 5,048,422 | A * | 9/1991 | Northrup et al. | 102/434 |
| 5,180,883 | A * | 1/1993 | Jaskolka et al. | 102/443 |
| 5,443,009 | A * | 8/1995 | Thiesen et al. | 102/443 |

FOREIGN PATENT DOCUMENTS

| | | |
|---|---|---|
| DE | 3512942 | 10/1986 |
| WO | WO 2004/070308 | 8/2004 |
| WO | WO 2006/077251 | 7/2006 |

* cited by examiner

*Primary Examiner* — James Bergin
(74) *Attorney, Agent, or Firm* — Squire Sanders (US) LLP

(57) ABSTRACT

Ammunition with structural and functional features such as to optimize the propellant combustion process when the weapon is fired, resulting in accelerated delivery of the combustion gases. For this purpose, advantageously, the ammunition at issue is fitted with an innovative firing system (4), the incendiary operation of which allows to ignite the entire quantity of propellant (7) in a homogeneous and capillary manner. In this operational circumstance, a considerably larger quantity of propellant (than that occurring with the known art) is therefore ignited in a shorter time. This results in accelerated delivery of the gases, such as to transmit to the projectile (5) an extremely fast burst of thrust, resulting in greater ballistic yield of the projectile and greater damage to the target.

5 Claims, 2 Drawing Sheets fig.3
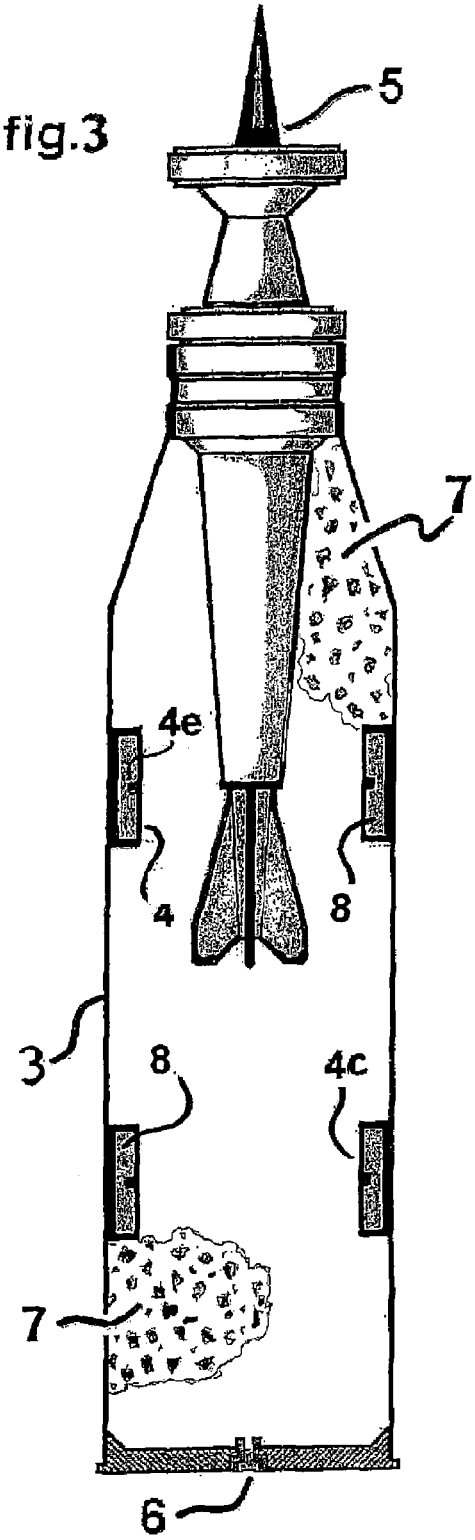
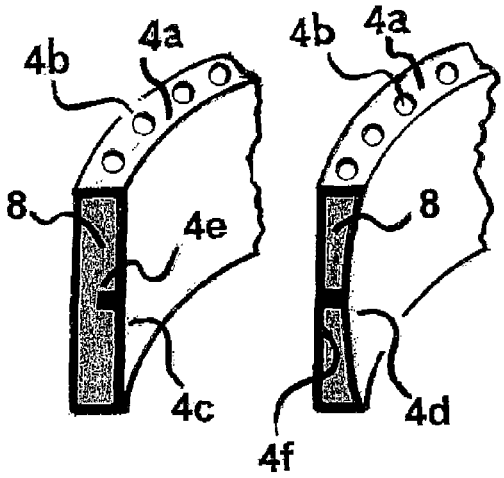
FIG. 6
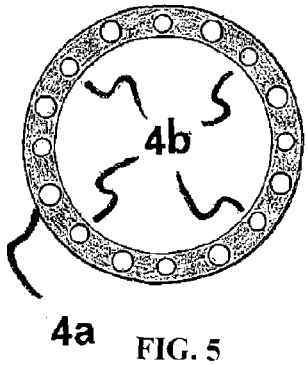
FIG. 5
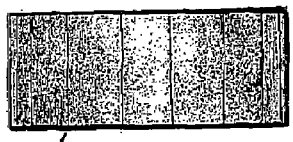
fig.4

CARTRIDGE FOR A FIREARM

FIELD OF THE INVENTION

The present invention relates to the firearm field. It relates to an ammunition, specifically to an ammunition for cannon.

STATE OF THE ART

All commonly known firearms use ammunition comprising a cartridge case containing gunpowder and sealed at the front by the projectile.

Presently, the development of ammunition and firearms has reached such levels that any further improvement in ballistic performance, although desirable, is increasingly difficult to achieve.

As is known, percussion on the primer case of an ammunition leads to the ignition of the explosive propellant contained therein, thus generating combustion gases. These gases increase the pressure around the propellant that has yet to burn, giving rise to the phenomenon that transforms combustion of the propellant into an explosion. The sudden increase in pressure enormously increases the rate of the combustion itself, resulting in the production of more gas that further increases the pressure by means of a chain reaction. The pressure values thus achieved can reach several thousand atmospheres.

The gases, strongly compressed, exert their propulsive action by forcing the projectile from the neck of the cartridge case and accelerating it along the barrel. In this manner the projectile reaches its maximum speed. Subsequently, the pressure giving thrust to the projectile, after reaching its peak value, inevitably begins to fall until the gunpowder is spent. However, there is a need for an innovative ammunition that will result in considerable improvement of the firing process.

FIELD OF THE INVENTION

The main object of the present invention is to provide an ammunition the structural and functional features of which optimise the combustion process of the propellant, particularly gunpowder, resulting in accelerated delivery of the combustion gases and an increase in the propulsion energy available.

For this purpose, advantageously, the ammunition at issue implies the use of a firing system, the incendiary operation of which allows to fully ignite the propellant instantaneously.

In this operational circumstance, the value of the consequent pressure peak is reached with a speed considerably greater than that which normally occurs with the known art. This results in a greater ballistic yield from the fired projectile. Therefore, the present invention is intended to achieve the above disclosed objectives by providing an ammunition having the features according to claim 1 and a firing process according to claim 7.

The ammunition according to the invention is particularly suitable for use in cannons and similar firearms. In the embodiment shown in FIGS. 1 and 2, the ammunition at issue includes a decalibrated projectile of the type APFSDS (the acronym for "Armour Piercing Fin Stabilized Discarding Sabot").

BRIEF DESCRIPTION OF THE FIGURES

Other features and advantages of the invention will become more apparent from the detailed description of preferred, though not exclusive, embodiments of an ammunition, which is disclosed by way of non-limitative example with the aid of the accompanying drawings, in which:

FIG. 3 shows the components of the system;

FIG. 4 show a front view of the supplementary ignition device;

FIG. 5 show a top view of the device in FIG. 4;

FIG. 6 show two partial views of the device in FIG. 4 respectively corresponding to two operation phases.

DETAILED DESCRIPTION OF A PREFERRED EMBODIMENT OF THE INVENTION

Figure 1:
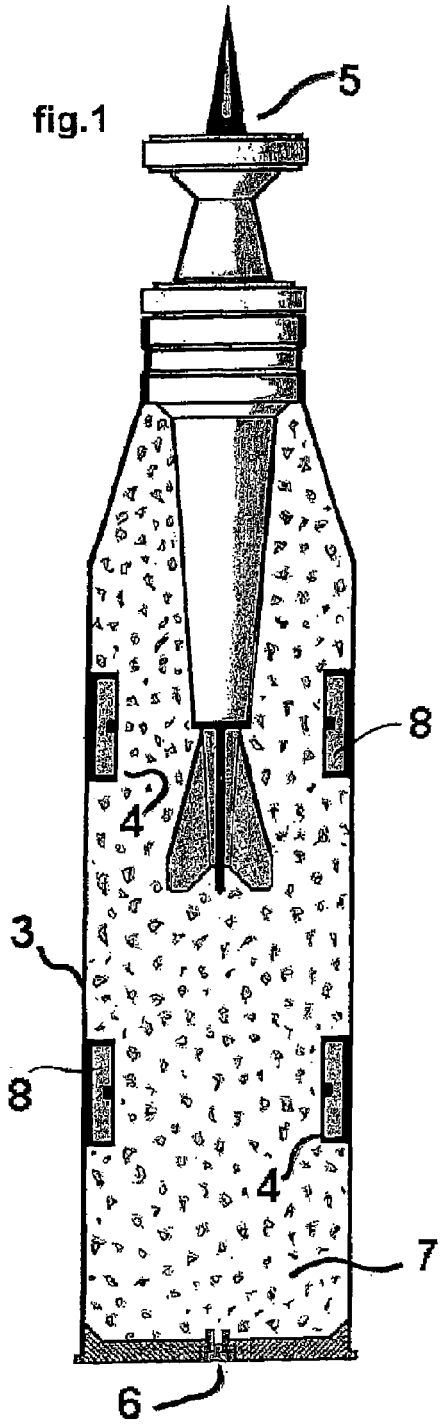
FIG. 1 shows a cross-section perspective view of the ammunition according to the invention, before firing.
Figure 2:
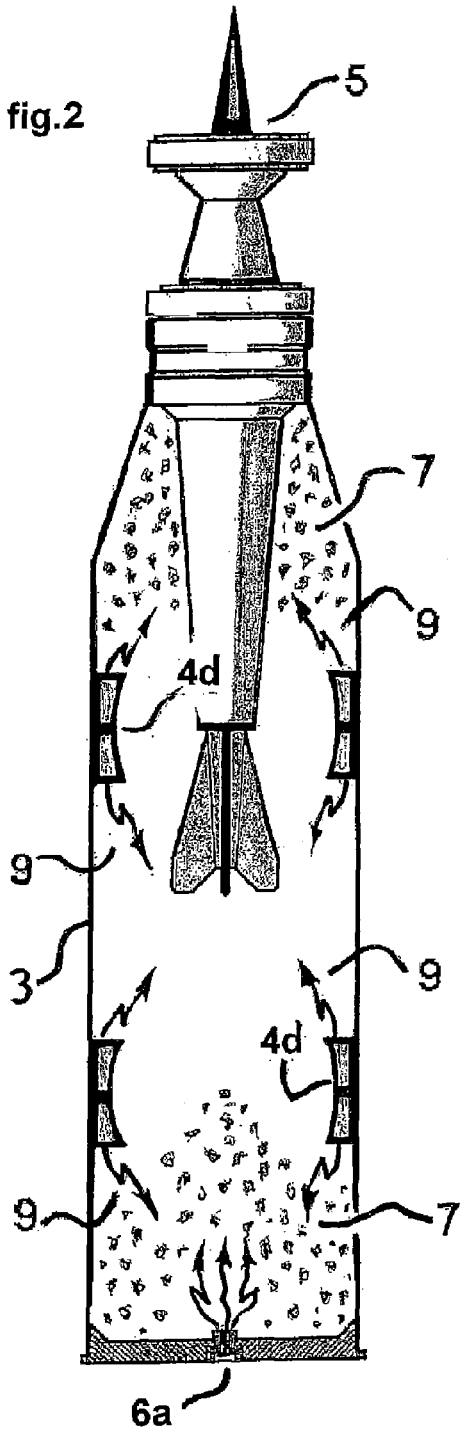
FIG. 2 shows a cross-section perspective view of the ammunition in FIG. 1 during the particular propellant ignition phase.

With reference to the figures, an ammunition is shown according to the invention comprising: a cartridge case 3; supplementary ignition devices 4; a projectile (APFSDS) 5; a primer case 6; propellant 7.

The cartridge case 3 contains the propellant 7 and is sealed at the front by the projectile 5 and at the rear it is closed by a traditional primer case 6.

According to the invention, advantageously, this ammunition provides for the use of appropriate supplementary ignition devices 4 (in the variant shown in the figures there are two devices) that are round in shape 4*a* (ring-shaped) and are arranged inside the cartridge case 3, thus immersed in the propellant 7.

Without departing from the invention, it is possible to have a smaller or greater number of supplementary ignition devices.

Each supplementary ignition device 4 also has an external wall that allows a perfect and integral fit against the internal wall of the cartridge case 3.

The structure of each device 4 has a rectangular section of hollow box metal plate, in the hollow space of which there is provided an appropriate mixture of igniting fulminate 8.

Each device 4 has a side 4*c* which is flexible, i.e. a side that, when subjected to strong atmospheric pressure, can deform to assume the position 4*d*.

It should also be noted that on the inner surface of the side 4*c*, there is provided a plurality of small strikers shown in enlarged detail 4*e*. These strikers are arranged in a circle and are in full contact with the mixture of igniting fulminate 8.

Finally, each device 4 has, on the top and/or bottom side 4*a*, a plurality of flash holes 4*b* or slots, arranged in a circle. These holes are directly in communication with the cavity of the device containing the mixture of igniting fulminate 8.

Once the ammunition is inserted into the corresponding burst chamber of the barrel and is locked in position by obturation, it is ready to be fired and functions as follows.

As usual, the percussion of the primer case 6*a* starts the ignition of the propellant 7, and in micro-fractions of a second combustion gases are generated at a very high pressure. These gases propagate around the remaining propellant that has yet to burn, and press with great force in all directions.

It should be noted that in this sequence the percentage of explosive propellant involved in the ignition is still low, and the projectile, due to inertia, is still in a state of rest.

The fundamental feature of the present invention is that, in this short space of time, this sudden increase in pressure presses intensely also against the sides 4*c* of the devices 4, causing them to bend violently, as illustrated in the detail 4*d*, as illustrated in FIG. 6.

The aim of the mechanical action described above is to cause the synchronised hitting of all the strikers 4*e* against the inner walls 4*f* of the devices 4, resulting in the percussion of the mixtures of igniting fulminate 8 they contain.

This mechanical action, obviously, results in the extremely fast detonation of the igniting mixtures 8, which, through the respective flash holes 4*b*, generate incandescent incendiary flashes 9, in all directions, that come into contact with and detonate in a homogeneous and capillary manner the entire quantity of propellant 7 available in the cartridge case 3.

In this operational circumstance, therefore a considerably larger quantity of propellant (than that which occurs with the known art) is ignited in a shorter time, giving rise to a chain reaction wherein the resultant speed of delivery of the gases increases more than exponentially.

Therefore, the achievement of a more effective peak of pressure, adapted to transmit a greater acceleration to the projectile, results in an increase in the kinetic energy of the projectile when it strikes the target, the kinetic energy being proportional to the square of the speed of the projectile.

The specific modes to embody the invention described above in no way limit the scope of the present application, which covers all the variants of the invention defined by the following claims.

The invention claimed is:

1. An ammunition for a firearm comprising a cartridge case, supplementary ignition devices, a projectile, a primer case, and a propellant, wherein said supplementary ignition devices are placed inside the cartridge case immersed in the propellant, and have a ring-shaped structure so as to achieve an optimal incendiary action, resulting in a homogeneous and capillary detonation of the propellant, wherein each supplementary ignition device consists of a metal sheet structure, said structure comprising a rectangular hollow profile in the hollow space of which there is a mixture of igniting fulminate, wherein each supplementary ignition device has a flexible side such that, when subjected to a strong ambient pressure, it can assume a deformed position, wherein a strong ambient pressure is the normal pressure generated by the combustion of the propellant in the cartridge case, wherein the external wall of each ignition devices being integrally attached to the internal wall of the cartridge case, and each of the ignition devices comprising the plurality of strikers on the inner surface it's the flexible side and a plurality of flash holes in the metal sheet structure of each of the igniters for propagating the flame front/ignition outward from the ignition devices, and wherein on the inner surface of the side of the supplementary ignition device there is a plurality of fixed strikers.

2. An ammunition according to claim 1, wherein the plurality of fixed strikers are arranged in a circle and are in full contact with the mixture of igniting fulminate, and wherein each ignition device comprises the flash holes.

3. An ammunition according to claim 2, wherein each supplementary ignition device has, on the top and/or bottom side a multitude of flash holes arranged in a circle and directly in communication with a cavity of the device itself containing the mixture of igniting fulminate.

4. A firing process for an ammunition according to claim 1, wherein there are provided the following steps:

a) percussion of the primer case and resulting ignition of the propellant, b) production of combustion gases at a very high pressure with immediate action on the sides of the devices causing the sides to bend, c) percussion of the mixtures of igniting fulminate and detonation of the mixtures resulting in the production of a plurality of incandescent incendiary flashes, and the homogeneous and capillary ignition of all the propellant, wherein the very high pressure is the normal pressure generated by the combustion of the propellant in the cartridge case.

5. A firing process according to claim 4, wherein, during the propellant ignition phase, there is provided a sudden increase in pressure, resulting in an increase in the speed of the projectile exiting from the barrel of the firearm.

* * * * *